US005673927A

United States Patent [19]

Vermillion

[11] Patent Number: 5,673,927

[45] Date of Patent: Oct. 7, 1997

[54] COMPOSITE SNOWBOARD INSERT AND METHOD OF INSTALLATION

[76] Inventor: James H. Vermillion, 2025 W. Century Way, Boise, Id. 83709

[21] Appl. No.: 523,542

[22] Filed: Sep. 5, 1995

Related U.S. Application Data

[63] Continuation-in-part of Ser. No. 343,783, Nov. 22, 1994, Pat. No. 5,609,351, which is a continuation-in-part of Ser. No. 27,632, Aug. 25, 1994, Pat. No. Des. 376,815.

[51] Int. Cl.[6] ..... A63C 11/00

[52] U.S. Cl. ..... 280/611; 280/14.2; 411/180

[58] Field of Search ..... 280/611, 14.2, 280/601; 411/180, 82, 258, 930, 908

[56] References Cited

U.S. PATENT DOCUMENTS

| | | | |
|---|---|---|---|
| 3,722,565 | 3/1973 | Miller, Jr. et al. | 411/180 |
| 4,747,613 | 5/1988 | Brichoud et al. | 280/611 |
| 4,871,186 | 10/1989 | Klosterman | 280/611 |
| 5,244,326 | 9/1993 | Henriksen | 411/180 |
| 5,391,031 | 2/1995 | Medal | 411/180 |

*Primary Examiner*—Richard M. Camby

*Attorney, Agent, or Firm*—Ken J. Pedersen; Barbara S. Pedersen

[57] ABSTRACT

Embodiments of a composite insert are shown and described, each embodiment being for attachment of bindings or other equipment onto a recreational board, such as a snowboard. Each insert is imbedded into the board in a counter-sunk hole drilled in the board. Each composite insert includes an internally-threaded core for receiving a binding bolt, and a sleeve that is secured to the core and that has a preferably non-circular base edge for anchoring the insert in the resin/cement in the snowboard hole. The core of the composite insert is preferably made of metal to supply a durable and reusable threaded bore for receiving the binding bolt. The sleeve is preferably made of plastic that is injection-molded around at least a flange or other projection from the core surface to secure the sleeve to the core. By making the core from a small-diameter piece of metal and the larger-diameter sleeve from a plastic such as glass-filled nylon, the resulting insert is more economical than the prior inserts, which require turning and machining of larger-diameter metal rods. The composite insert is preferably installed with a cap blocking the core opening to keep the core interior space clean until the cap is drilled out.

15 Claims, 5 Drawing Sheets

COMPOSITE SNOWBOARD INSERT AND METHOD OF INSTALLATION

This application is a continuation-in-part of my prior application, Ser. No. 08/343,783, filed Nov. 22, 1994, now U.S. Pat. No. 5,609,351 and entitled "Snow Board Insert with Hexagonal Base", which is a continuation-in-part application of my prior, application, Ser. No. 29/027,632, filed Aug. 25, 1994, now U.S. Pat. No. D. 376,815 and entitled "Insert With Hexagonal Base", the specifications of which are hereby incorporated herein by reference.

BACKGROUND OF THE INVENTION

1. Field of the Invention

This invention relates generally fasteners, and to fasteners for to snowboards and snowboard bindings. More specifically, this invention relates to the threaded inserts that are secured in holes bored into snowboards for connecting bindings to the boards.

2. Related Art

Snowboarding is a sport that is fast-growing in popularity. The snowboard is broader and shorter than a ski and is typically made of a wood or foam core wrapped in fiberglass. The tips, tails and top of the board are typically covered in ABS plastic, and the edges are typically carbon steel. The snowboard bottom surface, or base, is covered with P-Tex™.

The snowboarder's feet are typically held by two bindings on a single snowboard. The bindings are of many designs, but usually each binding includes bottom brackets that extend out from both sides of the binding and are screwed or bolted onto the snowboard. The screws or bolts are screwed into metal inserts that are imbedded in the board.

A standard metal insert is rivet-shaped, with a cylindrical shaft, which has a threaded hollow interior, and a round base, which has a circular outer perimeter edge. Some standard inserts are textured on the exterior surface of the shaft.

During manufacture of the board, the standard insert is pushed up into a counter-sunk hole bored through the board from the bottom to the top. The cylindrical shaft extends up into the smaller-diameter portion of the hole, reaching up about flush with, or slightly below, the top surface of the snowboard, so that the threaded interior surface can receive the binding screws. The round base rests in the larger-diameter counter-sunk portion of the hole. In the manufacture of new boards, resin-soaked fiberglass fabric is then wrapped around the board, covering both ends of the inserts. The liquid resin tends to seep in and harden around and inside the inserts.

In repair or retrofit of inserts into used boards, a filler such as cement, epoxy, or other adhesive is poured into the hole around the insert to secure the insert in place and to fill the hole. P-Tex™ is then applied over the hole on the bottom of the snowboard to create a smooth snowboard base.

The standard inserts are typically installed in 8–16 holes, which lie in various arrangements on the snowboard to accept different types of bindings and to allow for adjustment in the position of the bindings on the board. The plurality of holes and inserts allows the user to set up the binding positions for his/her stature, snowboarding style, and ability.

The standard insert base is a circular flange that provides an anchor to prevent the insert from being pulled up and out of the hole by the forces on the bindings. The diameter of the base typically is about 1.75–2.5 times the diameter of the cylindrical shaft. This base diameter provides a ledge with a large surface area that abuts up against the portion of the snowboard that surrounds the smaller-diameter portion of the hole. Because typically more than half of the thickness of the snowboard lies above the insert base, the base, and consequently the whole insert, is prevented from being pulled up out of the board by normal use.

The standard inserts do tend, however, to become loose and rotate inside the snowboard holes around the insert cylindrical axis. Over-tightening of the binding screws, or just the repeated torque on the inserts from adjustment and use, can break the inserts loose from the cement or resin. The inserts then can rotate in the holes, making installation or removal of the bindings difficult, if not impossible.

What is needed is an improved method of securing bindings to snowboards. What is needed is an improved system that may be installed during manufacture of snowboards or that may be retrofit into used snowboards.

SUMMARY OF THE INVENTION

An object of the present invention is to provide an improved means for connecting bindings to snowboards. Another object of the present invention is to provide an improved method for installing inserts in snowboards during manufacture of the boards. Another object is to provide an inexpensive, effective connection device that may be easily retrofit into used boards, without damage to the board, without compromising the strength of the board, and without expensive and difficult procedures.

The present invention comprises a composite insert having a core member for connection to the snowboard binding, and an anchoring member, which is attached to the core member, for anchoring the insert in the hole. The core member and anchoring member are different materials, with the smaller core member preferably being made of metal for strength and durability through many uses, and the relatively larger and larger-diameter anchoring member preferably being made of less expensive plastic.

Preferably, the core member has a threaded inner bore for receiving a binding bolt and a flanged end or other protrusion for securing the core in the anchoring member. Preferably, the anchoring member is a sleeve that is attached to the core by way of a portion of the sleeve extending around at least a part of the core, for example, around the flange or protrusion from the core. Preferably, the sleeve has a flange-shaped bottom end base, which extends radially out into the large-diameter portion of the counter-sunk portion of the hole to anchor the insert in place. Preferably, the core and sleeve top portion are generally cylindrical and coaxial to form a barrel portion of the insert, and preferably the sleeve base lies generally perpendicular to the cylindrical axis of the barrel portion. Preferably, the sleeve is glass-filled nylon or other plastic that can be molded around the core.

The composite insert is preferably installed during board manufacture by a novel method that uses a means for covering the opening of the threaded bore of the insert. This cover prevents resin, cement, or other materials from entering, plugging, and fouling the bore and threads. The preferred cover means is a cap that is designed to shred or otherwise disintegrate when a drill or other sharp tool is inserted through the fiberglass layers and into the bore.

The composite insert and method of installation provide a very economical and effective system for snowboard manufacture, repair or retrofit. The composite insert is strong and resistant to becoming loose and rotating in the snowboard hole. The composite insert is economical because only a portion of the insert is metal and that metal portion has small outer and maximum diameters, relative to other insert designs. The cover means and method of installation save time and prevent thread fouling and damage.

DETAILED DESCRIPTION OF THE PREFERRED EMBODIMENT

Figure 1:
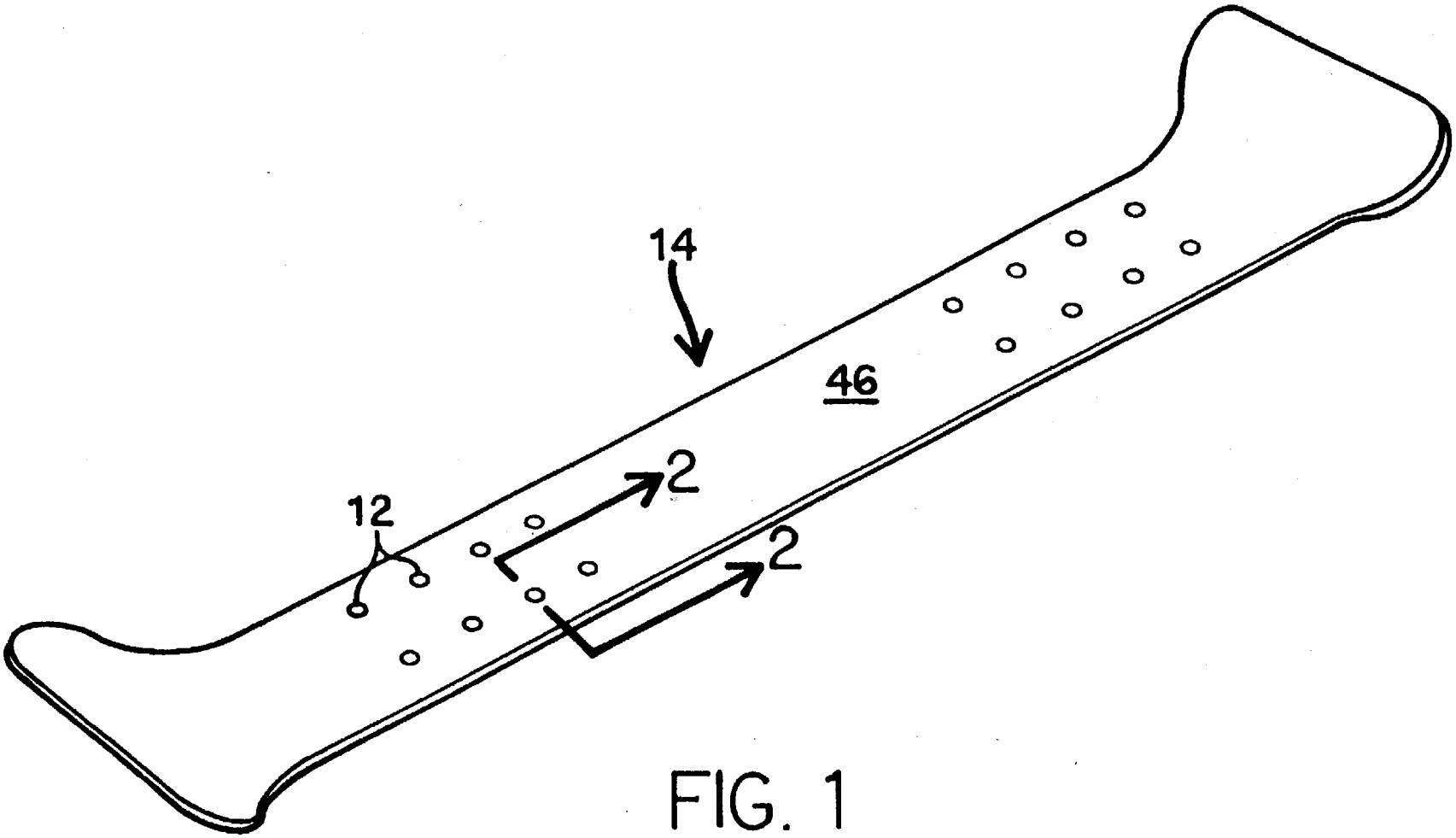
FIG. 1 is a perspective view of a snowboard, showing sixteen holes for binding attachment.
Figure 2:
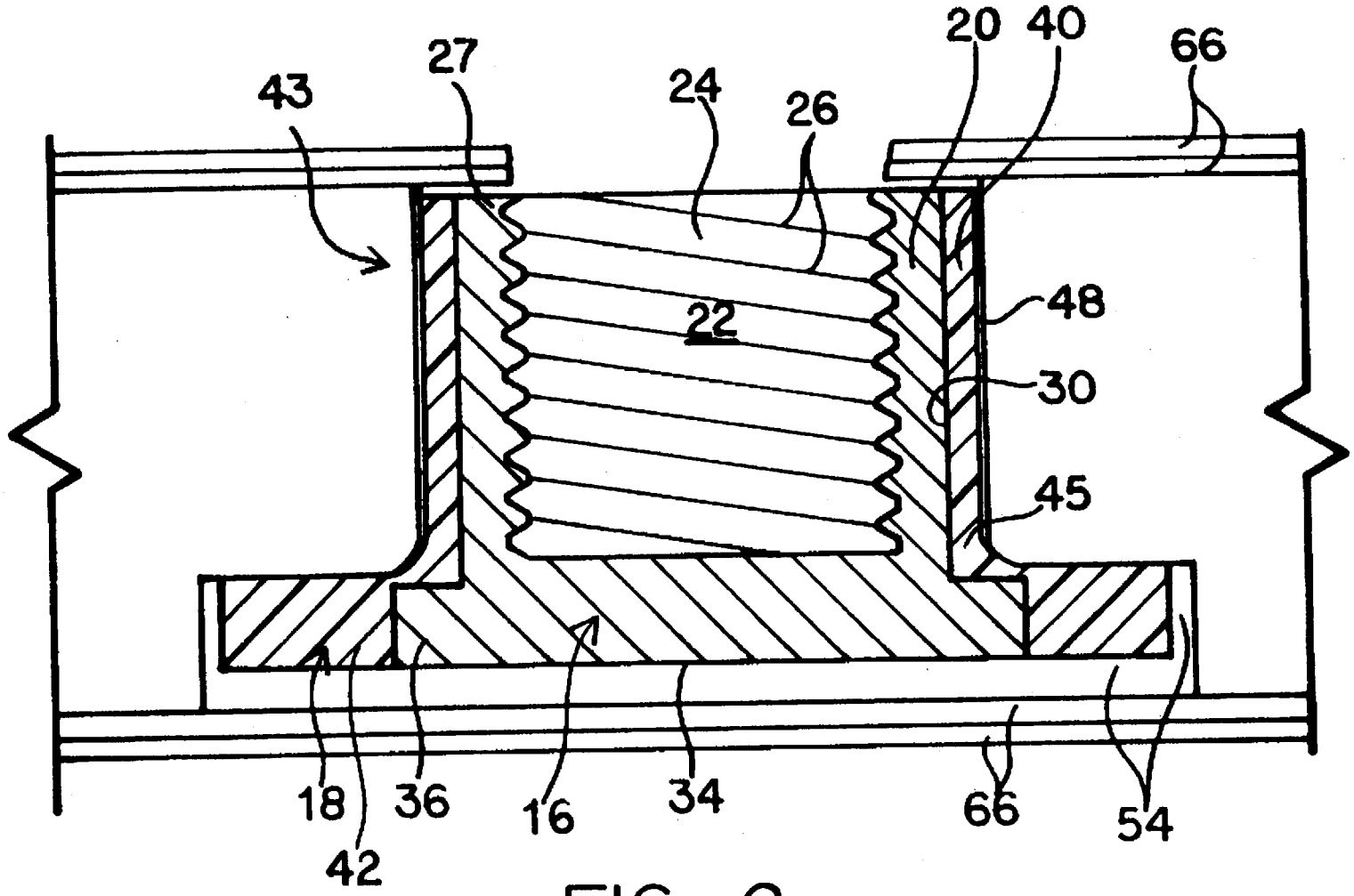
FIG. 2 is a cross-sectional view of a portion of the snowboard of FIG. 1 and an embodiment of the invented composite insert, viewed along the lines 2—2 in FIG. 1.
Figure 3:
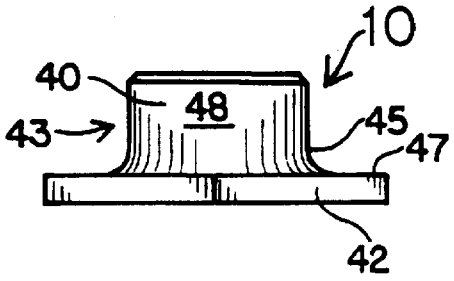
FIG. 3 is a side view of the composite insert of FIG. 2.
Figure 4:
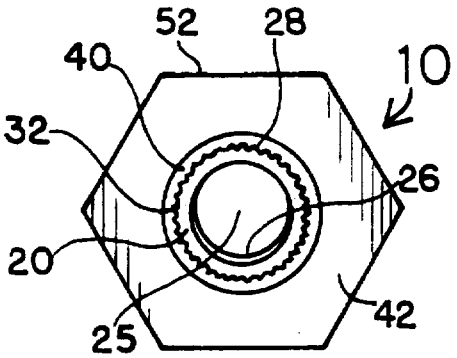
FIG. 4 is a top view of the composite insert of FIG. 2.
Figure 5:
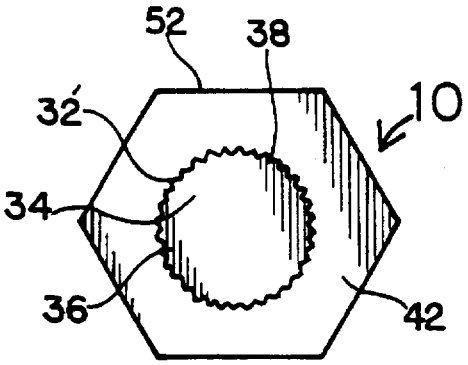
FIG. 5 is bottom view of the composite insert of FIG. 2.
Figure 6:
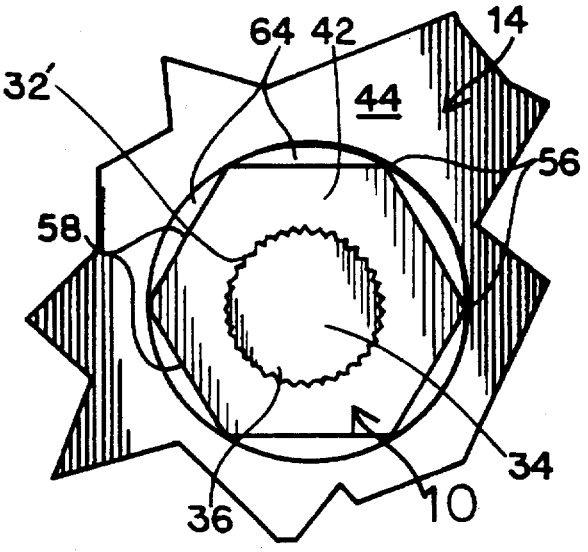
FIG. 6 is a bottom view of the composite insert of FIG. 2 inserted into a hole in a snowboard.
Figure 7:
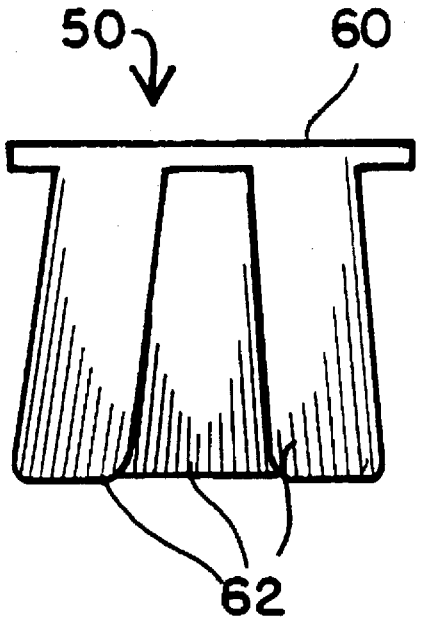
FIG. 7 is a side view of an embodiment of the invented cap for installation of the composite insert.
Figure 8:
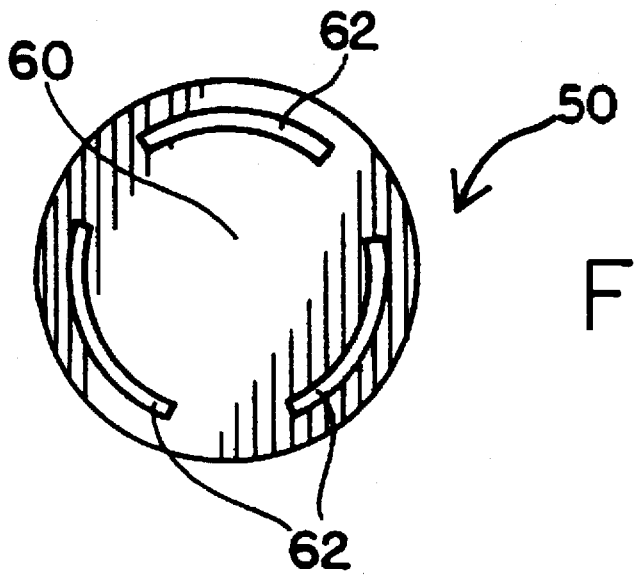
FIG. 8 is a bottom view of the cap of FIG. 7.
Figure 9:
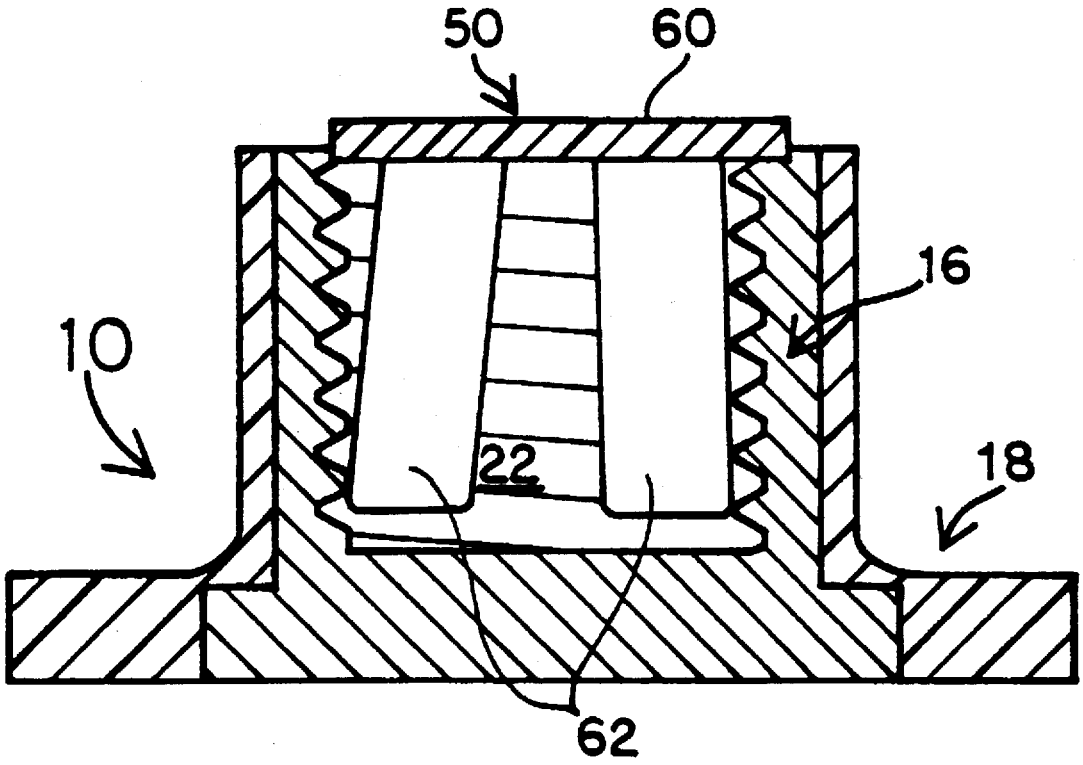
FIG. 9 is cross-sectional view of the composite insert of FIG. 2 combined with the cap of FIG. 7.

Referring to FIGS. 2–6, there is shown one, but not the only, embodiment of the invented composite insert 10, which is placed into the hole 12 of a snowboard 14 for connection to the snowboard bindings. The insert 10 comprises a core 16, which receives a binding bolt or screw, and a sleeve 18, which encircles at least part of the core 16 and has a base for anchoring the insert 10 in the snowboard hole 12. In this description and the claims, the term binding bolt includes any threaded fastener that may be received in the insert.

The core 16 of the insert 10 has a hollow cylindrical barrel 20 with a threaded interior surface 22 defining a bore, hereafter called an "interior space" 24, and an opening 25 into the interior space 24 at the top end 27 of the core 16. The threads 26 and interior space 24 receive the screws or bolts of the bindings (not shown) to hold the bindings on the board 14.

The exterior surface 28 of the core barrel 20 has a knurled texture for gripping the sleeve interior surface 30. The knurling may be any texture designed to improve the frictional engagement of the core exterior surface 28 with the sleeve. Preferably, the knurling is a plurality of vertical, V-shaped channels 32 that engage the sleeve material, which preferably is plastic molded around the core 16.

The closed, bottom end 34 of the core 16 comprises a flange 36 which extends generally radially out from the barrel 20. The flange 36 preferably is knurled by having vertical V-shaped channels 32 cut into its outer edge 38. Thus, the protruding edges, created by cutting the channels 32, 32' into the core barrel 20 and flange 36, extend into the plastic material of the sleeve 18 to prevent the core 16 from rotating inside the sleeve 18.

The sleeve 18 comprises a top portion, which is called the "sleeve barrel" 40, and a bottom portion, which is called the "base" 42. The sleeve barrel 40 extends around and is coaxial with the core barrel 20. The sleeve barrel 40 extends around at least a part of the core 16 to secure the core 16 and sleeve 18 together, and, preferably but not necessarily, the sleeve barrel extends so that its top end reaches all the way to the top end 27 of the core barrel 20. The base 42 is preferably a hexagonal, generally planar member extending radially and integrally from the sleeve so that it lies generally in a plane perpendicular to the axis of the sleeve barrel 40 and generally coplanar with the core flange 36. The insert barrel portion 43, comprising the core barrel 20 and sleeve barrel 40, may be described as generally cylindrical with a vertical cylindrical axis. The base 42 and the flange 36 may be described as extending out horizontally from the sleeve barrel 40 and the core barrel 20, respectively. The base 42 extends out horizontally past the horizontal extent of the barrel portion 43, that is, out past both the horizontal extents (outermost horizontal regions) of the core 16 and the sleeve barrel 40.

The junction 45 between the base 42 and the sleeve barrel 40 preferably forms a sloping or cone-shaped transition. This sloped junction 45 serves to provide a tight fit of the insert 10 in the hole 12, as well as to cover the core flange 36 and to strengthen the sleeve 18 in the area of the core flange 36.

The core 16 is secured in the sleeve by way of the flange 36 being at least partially imbedded in the sleeve 18 and the flange 36 abutting up against the sleeve 18 in the area of the junction. Alternatively, the core may have protrusions other than a flange extending from its exterior surface for becoming imbedded in the sleeve to attach the sleeve to the core. Alternatively, the sleeve may attach to the core by frictional engagement of the sleeve with the core as the sleeve extends around at least a part of the core. "Extending around at least a part of the core" means that the sleeve encircles or extends radially around the entire core or around, for example, a portion of the core, such as the bottom flanged or flared end of the core. "Imbedded" means that a flange or other protrusion of the core intimately contacts the sleeve on at least two faces of the protrusion surface, including an upper face, so that the core is held in the sleeve when the core is pulled upwards.

When installed in the board, the barrel portion 43 extends up into the small-diameter portion of the counter-sunk hole 12, and the base 42 lies in the large-diameter portion of the counter-sunk hole 12. Thus, the core barrel 20 is accessible for connection to the bindings and the base 42 anchors the insert 10 in the hole to prevent the insert 10 from being pulled up out of the board 14.

The generally planar, hexagonal base 42 is an especially effective shape for the base, because it supplies six corners 56 and six flat segments 58 for gripping the resin, while also creating a large and symmetrical surface of top ledge 47 for abutting against the snowboard material surrounding the hole 12. The corners 56 and segments 58 grip and push against the hardened resin 54 to prevent rotation around the cylindrical axis of the insert even after repeated torque and use of the inserts 10. This contrasts with the standard insert base, which has a smooth, circular outer edge that slips along the resin/cement to allow the insert to rotate.

Alternatively, the base 42 may be other non-round shapes, that is, shapes that provides a non-circular outer edge 52 for gripping against the resin 54. For example, a triangular, square, pentagonal, octagonal, or other corner-and-flat-segment shape would be effective. Also, even a non-round but smooth shape, such as an oval, would supply the gripping feature for anchoring the base, and therefore the insert, in the resin. The base 42 may optionally include texture or protrusions, as long as the texture or protrusions do not extend so far that they would extend out from the bottom surface 44 of the board 14.

The preferred core 16 is made from 38 inch brass base stock, or, alternatively, stainless steel 303 or titanium. The core is preferably shaped in a six-station screw machine. The base stock is turned down to a cylindrical shape featuring the smaller-diameter barrel 20 and the larger-diameter flange 36. The barrel 20 is knurled, drilled to create the interior space 24, and tapped to create the threads 26. Preferably, the flange 36 is then knurled.

The sleeve 18 is formed around the core 16 preferably by plastic injection-molding. The core 16 is placed in a mold and preferably glass-filled nylon is injection-molded around the core 16 to form the sleeve. The intimate contact between the molded plastic of the sleeve and the knurled core surfaces secure the core 16 and sleeve together to prevent any movement of the core 16 relative to the sleeve 18 during installation or use.

The exact dimensions of the insert 10 may vary to fit various snowboards and binding screws from various manufacturers. One embodiment of the insert 10 has a base 42 that is about ¾ inches between opposite corners, and has a sleeve barrel 40 that has about a ⅜ inch outer diameter (O.D.) and is about 3/16 inch high. For this particular embodiment, the core 16 is ¼ inch high, with a 5/16 inch core barrel 20 O.D. and a 11/32 inch O.D. flange 36. Thus, a preferred core maximum diameter, which is the flange 36 diameter, is about the same or smaller than the O.D. of the sleeve barrel.

The shapes and relative sizes of the core 16 and sleeve 18 make the invented insert 10 very economical. The metal core supplies a strong and reusable threaded connection means, which is relatively small in size and has a narrow maximum diameter and, thus, requires less turning and material removal during machining. The plastic sleeve 18 provides a means for sizing the insert to fit into the snowboards holes and for providing the larger diameter base for anchoring the insert in the hole. Thus, the bulk of the insert is molded plastic, while the metal core, which is a more expensive material and more expensive to form, is a relatively small part of the insert.

The insert 10 is installed into the snowboard 14 in a novel manner, using a cover means for protecting the threads 26 and interior space 24. First, a hole 12 is drilled through the board 14 from the board bottom surface 44 to the top surface 46 and the hole is countersunk, as in the standard procedure. The small-diameter portion of the hole 12 is sized to create a close fit between the sleeve outer surface 48 and the hole, and the sloped junction 45 helps create a tight fit when the insert is pushed into the hole. Before insertion of the insert 10 into the hole 12, a cover means is positioned on the insert 10 to prevent particulate, resin or cement from entering the interior space 24. The preferred cover means is a plastic cap 50, with a top 60, which extends across and blocks the opening 25, and legs 62, which extend into the interior space 24 and resiliently press out on the interior surface 22 to temporarily hold the cap 50 in place. After the capped insert 10 is pushed into the hole 12, the board is typically wrapped with resin-soaked fiberglass fabric 66, called "Pre-Preg"™. The board is then pressed to create the proper board profile. The resin seeps and hardens around the base 42 and at least part way around the barrel portion 43. The spaces 64 between the segments 58 and the hole 12 fill with resin 54 to create a tight, secure, and more permanent installation than in the case of the prior art inserts. An outer membrane, such as a polypropylene finish coat, is applied to the board.

After the resin has hardened and the board is finish-coated, the board 14 is placed in a drill station, where a drill extends down from the board top surface 46 into the core interior space 24. The drill breaks through the coating and fiberglass layers on top of the insert 10 and breaks apart or shreds the cap 50, preferably without contacting or damaging the threads 26. Thus, the cap is removed and the clean interior space 24 is uncovered for use.

The insert 10 may also be installed into a used board 14 for repair or adjustment of binding location. After inserting the insert 10 into the hole, cement or other adhesive or filler is added to the hole 12 to harden around the base 42. After cementing the insert 10 in place, P-Tex™ is typically applied to the board bottom surface 44 to create a smooth and flawless surface. The preferred cement is a two-part epoxy.

The invented insert 10 is not limited to use with snowboards, but may be used with any recreational board, such as a ski, a sled, a toboggan, etc. A recreational board is defined as a board that holds a person or part of a person for entertainment or sport, the recreational board having a bottom surface for contacting snow, water, carpet, or earth, etc., wherein it is important, for the sliding or motion of the board, that the bottom surface is smooth and uninterrupted by protruding bolt heads, nails, etc.

Although this invention has been described above with reference to particular means, materials, dimensions, embodiments, and methods of installation, it is to be understood that the invention is not limited to these disclosed particulars, but extends instead to all equivalents within the scope of the following claims.

I claim:

1. A composite insert for being imbedded in a snowboard for receiving a binding bolt, the insert comprising:

a) a generally cylindrical core having a top end, a bottom end, a vertical cylindrical axis extending between the said top and bottom ends, a horizontal extent, and a threaded interior surface defining an interior space having an opening near the said top end for receiving the binding bolt; and b) a sleeve having a top portion and a bottom base, wherein:

the top portion has a horizontal extent and extends around at least part of the said core member to attach the sleeve to the core member; and wherein the said base lies substantially in a plane perpendicular to the said core cylindrical axis and extends horizontally beyond both the said horizontal extents of the core and the sleeve top portion; and wherein the said core and said sleeve comprise different materials.

2. A composite insert as set forth in claim 1, wherein the said base is generally planar and has an outer edge that is not circular.

3. A composite insert as set forth in claim 2, wherein the said outer edge is hexagonal.

4. A composite insert as set forth in claim 1, wherein the said core bottom end comprises a flange extending horizontally out from the core and being imbedded in the sleeve.

5. A composite insert as set forth in claim 1, wherein the core is metal material and the sleeve is a plastic material.

6. A composite insert as set forth in claim 1, further comprising a cover means for temporarily blocking the said opening into the interior space.

7. A composite insert as set forth in claim 6, wherein the said cover means comprises a cap having a top extending across the opening and a plurality of resilient legs for extending into the interior space and contacting the interior surface.

8. A binding attachment system for receiving binding bolts, the system comprising:

a) a recreational board having a bottom surface, a top surface, and a counter-sunk hole with a large-diameter portion and a small-diameter portion bored through the board from the bottom surface to the top surface; and b) a composite insert received in the said hole, the insert comprising:

a core extending to near the board top surface and having an interior surface defining an interior space with an opening adapted for receiving the said binding bolt; and a sleeve attached to the said core and comprising a base lying in the large-diameter portion of the said hole and in a plane generally parallel to the said bottom surface of the board for preventing the said insert from being pulled up out of the hole; and wherein the said core and said sleeve comprise different materials.

9. A binding attachment system as set forth in claim 8, wherein:

the core member is generally cylindrical and has a top end near the said board top surface, a bottom end, a vertical cylindrical axis extending between the said top and bottom ends, and a horizontal extent;

the sleeve has a generally cylindrical top portion having a horizontal extent and extending coaxially around at least part of the said core to attach the sleeve to the core; and the said sleeve base extends horizontally beyond both the said horizontal extents of the core and the sleeve top portion.

10. A binding attachment system as set forth in claim 8, wherein the said base is generally planar and has an outer edge that is not circular.

11. A binding attachment system as set forth in claim 10, wherein the said outer edge is hexagonal.

12. A binding attachment system as set forth in claim 8, wherein the said core bottom end comprises a flange extending horizontally out from the core and being imbedded in the sleeve.

13. A binding attachment system as set forth in claim 8, wherein the recreational board is a snowboard.

14. A binding attachment system as set forth in claim 8, further comprising a cover means for temporarily blocking the said opening into the interior space.

15. A binding attachment system as set forth in claim 14, wherein the said cover means comprises a cap having a top extending across the core opening and a plurality of resilient legs for extending into the interior space and contacting the core interior surface.

* * * * *